US005147034A

United States Patent [19]

Broadhead et al.

[11] Patent Number: 5,147,034

[45] Date of Patent: Sep. 15, 1992

[54] SLIDING RAIL LATCH MECHANISM

[75] Inventors: Robert M. Broadhead, Hall Farm Cottage, Chattisham, Ipswich, IP8 3PX, England; David F. Whitehead, Romford, England

[73] Assignee: Robert M. Broadhead, Ipswich, 05

[21] Appl. No.: 747,998

[22] Filed: Aug. 21, 1991

[30] Foreign Application Priority Data

Apr. 22, 1991 [GB] United Kingdom ..... 9108603

[51] Int. Cl.[5] ..... B65D 85/30; A45S 13/18

[52] U.S. Cl. ..... 206/1.5; 206/807; 206/818; 206/444; 206/387; 206/45.34

[58] Field of Search ..... 206/1.5, 387, 807, 818, 206/444

[56] References Cited

U.S. PATENT DOCUMENTS

| | | | |
|---|---|---|---|
| 4,285,429 | 8/1981 | MacTavish | 206/565 X |
| 4,466,540 | 8/1984 | Lotrous et al. | 206/1.5 X |
| 4,567,983 | 2/1986 | Morris | 206/1.5 X |
| 4,572,369 | 2/1986 | Morris | 206/1.5 X |
| 4,865,190 | 9/1989 | Gregerson et al. | 206/1.5 X |
| 4,881,645 | 11/1989 | Smiler et al. | 206/1.5 |
| 4,932,526 | 6/1990 | Nehl et al. | 206/1.5 X |

*Primary Examiner*—William I. Price
*Attorney, Agent, or Firm*—Charles D. Gunter, Jr.

[57] ABSTRACT

The present invention relates to a container adapted to contain one or more articles, notably a case for a compact disc, which container has access means whereby the article(s) can be inserted into or removed from the container, the container being provided with a detent mechanism adapted to retain the article within the container, which detent mechanism comprises:

a. a sole plate member located adjacent the interior of one wall of the container and adapted to move axially substantially parallel to the plane of that wall and to bear against a face of the article which is to be inserted into or removed from the container through said access means;

b. a biassed member adapted to move betweeen an operative position, at which the member engages the sole plate member so as to retain it against axial movement, and an inoperative position, at which the biassed member permits axial movement of the sole plate member; and c. a stop member, which can be provided by the biassed member or by a stop member carried by the sliding member, which stop member is adapted to engage said article and to retain said article within the container when said biassed member engages the sole plate member in its operative position.

The invention also provides a detent mechanism suitable for use with the container.

10 Claims, 3 Drawing Sheets

SLIDING RAIL LATCH MECHANISM

The present invention relates to a locking mechanism, notably to a latch mechanism for a display container.

BACKGROUND TO THE INVENTION

Compact discs, audio and video tapes are usually put up for sale in a plastic case or the like, which carries information about the disc or tape as well as carrying sales promotional material or artwork to attract a purchaser. The case is often displayed at the point of sale in an open access rack or other display so that a would-be purchaser can browse through the display and select the discs or tapes he wishes to purchase. However, in order to reduce the risk of theft from such an open access display, the actual disc or tape is not held within the displayed case, but is stored separately. Therefore, when the disc or tape is purchased, the sales person has to identify the disc or tape from the empty case, to locate the disc or tape in the store and to marry the disc or tape up with the empty case. This is time consuming and may also require that the sales person leaves the sales counter un-manned whilst locating the disc or tape in the store.

In order to reduce these problems, it has been proposed to fit the case into a display container fitted with a lock mechanism which secures the case for the disc or tape within the container so that a thief cannot readily gain access to the disc or tape without breaking the container or removing the container from the shop. The container can be fitted with alarm means so that it cannot be removed from the display or shop without actuating an audible or visual alarm. Typically, the container is locked by means of a spring loaded pin which engages a recess or the like in a wall of the case. The pin is retracted by applying a strong magnet to the pin mounting, for example at the sales counter, so as to release the case from the container. However, such mechanisms are either bulky and obtrusive, or can be accessed externally so that the security of the container is compromised. Furthermore, the pin must register with a recess in the wall of the case and this limits the range of cases which can be used within a given container, notably where the design of the case is altered by the manufacturer. The pin must also be retracted when the case is loaded into the display container, which again is time consuming.

We have now devised a form of lock mechanism for a box or other container, notably for use with an article which is to be on open access display and thus susceptible to theft, which reduces the above problems.

SUMMARY OF THE INVENTION

Accordingly, the present invention provides a container adapted to contain one or more articles, which container has access means whereby the article(s) can be inserted into or removed from the container, the container being provided with a detent mechanism adapted to retain the article within the container, which detent mechanism comprises:

a. a sole plate member located adjacent the interior of one wall of the container and adapted to move axially substantially parallel to the plane of that wall and to bear against a face of the article which is to be inserted into or removed from the container through said access means;

b. a biassed member adapted to move between an operative position at which the member engages the sole plate member so as to retain it against axial movement, and an inoperative position at which the biassed member permits axial movement of the sole plate member; and c. a stop member, preferably carried by said sole plate member, adapted to engage said article and to retain said article within the container when said biassed member engages the sole plate member in its operative position.

Preferably there is a second stop member carried by the sole plate member which is adapted to engage said article as it is inserted into the container, whereby the sole plate member is moved axially by said article as it is inserted into the container so that the first stop member prevents removal of the article from the container when the sole plate is carried by the article to the position at which the sole plate member is engaged by the biassed member.

Preferably, the sole plate member is provided with a portion which moves transversely out of the path of the article as the article is withdrawn from the container so that the first stop member and the article move transversely with respect to one another so that the first stop member lies out of the path of the article and thus permits its removal from the container.

The invention can be applied to retaining a wide range of types of article within a wide range of shapes and sizes of container. However, the invention is of especial application in retaining a single generally rectangularly shaped article within a correspondingly shaped chamber within a container into which the article is a sliding fit. Thus, the invention is of use in retaining a book or similar article within a clear walled container so that the book is protected within the container and yet cannot be removed until the biassed member is moved to its inoperative position. For convenience, the invention will be described hereinafter in terms of a compact disc (CD) in its case to be retained within a clear plastic walled container of the invention.

DESCRIPTION OF THE DRAWINGS

To aid understanding of the invention, it will be described with respect to a preferred form thereof as shown in the accompanying drawings, in which.

DESCRIPTION OF THE PREFERRED EMBODIMENT

Figure 1:
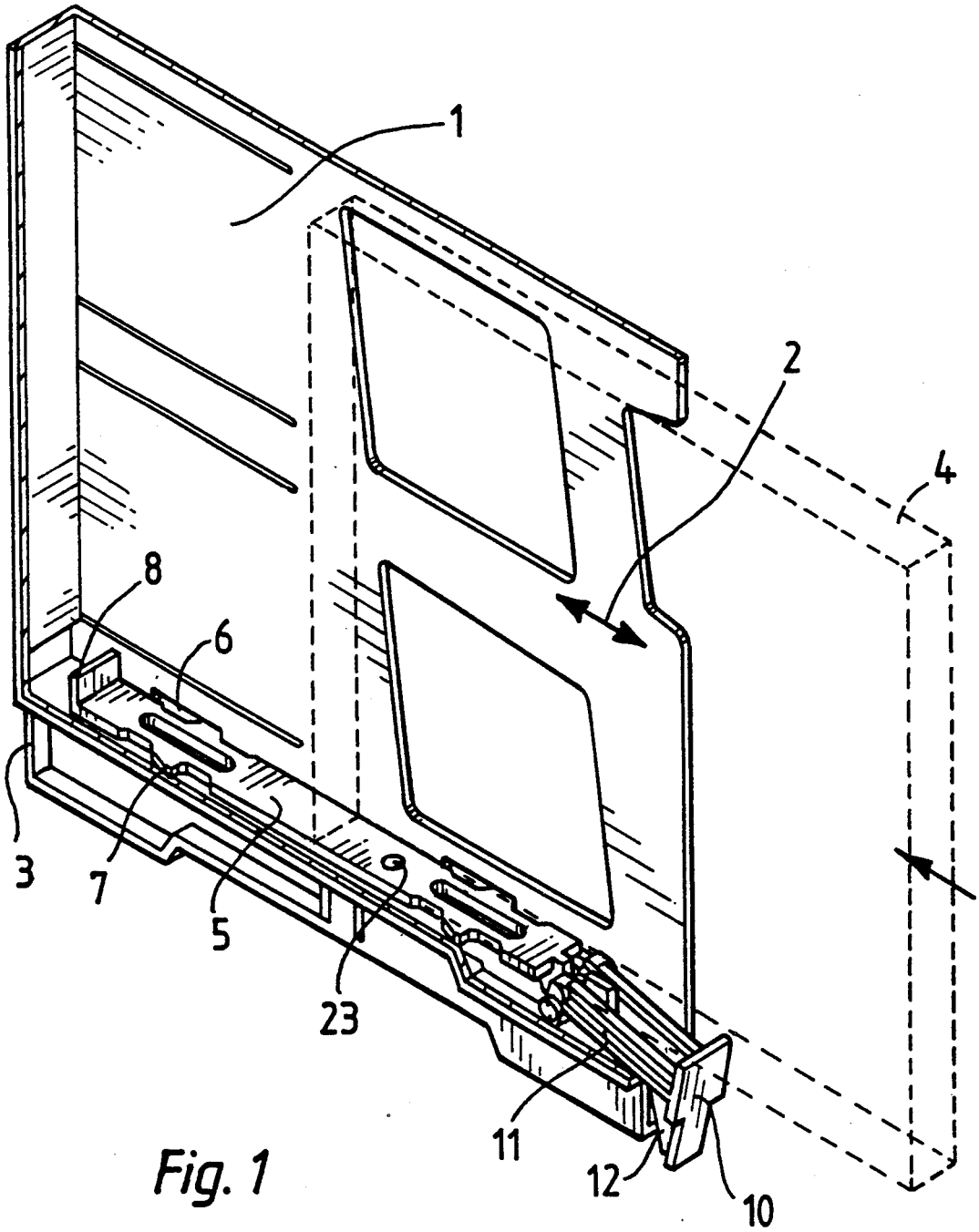
FIG. 1 is a diagrammatic part sectional side elevation of the container ready to receive the case of a CD.
Figure 2:
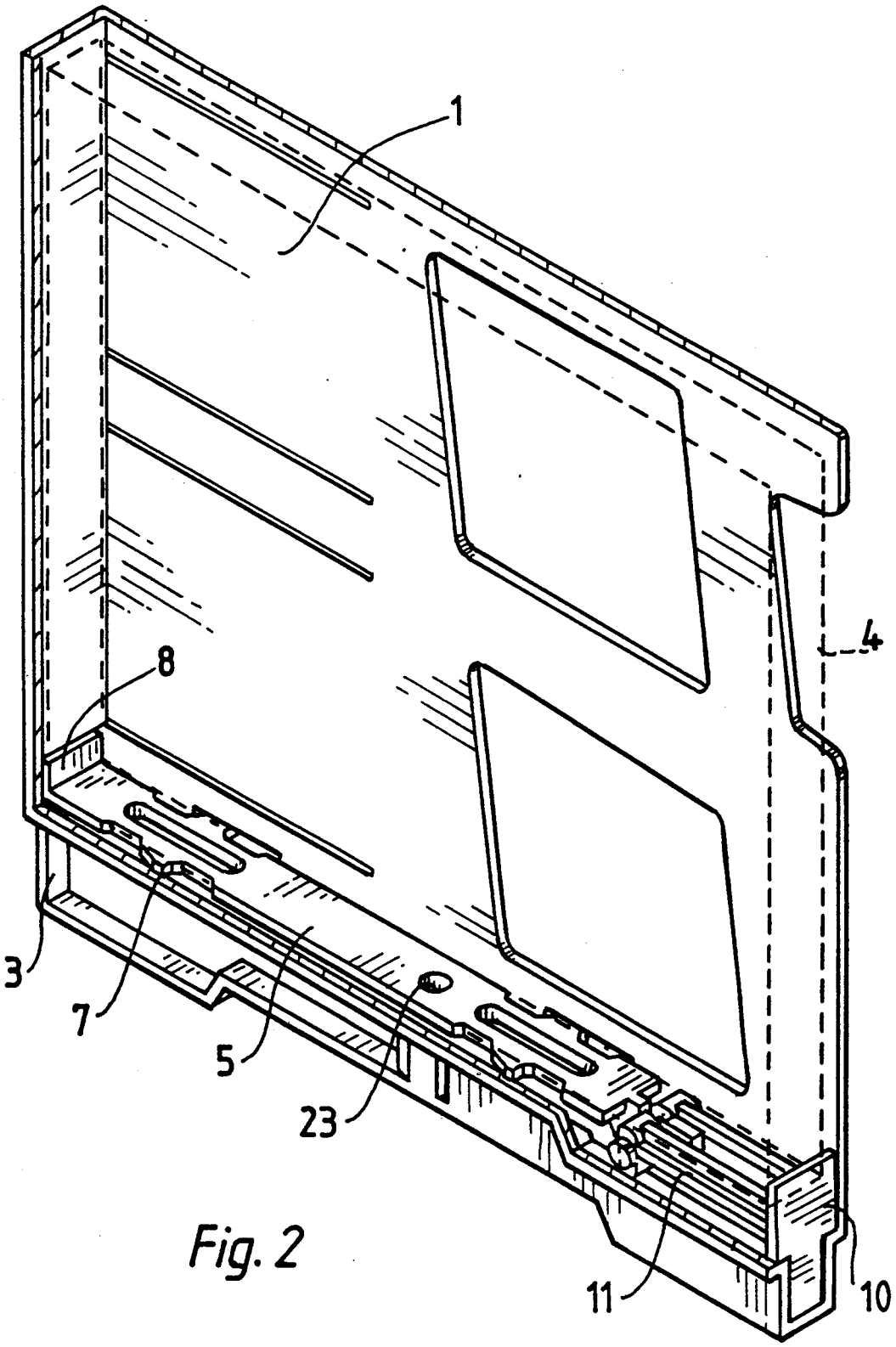
FIG. 2 shows the container of FIG. 1 with the lock mechanism in the position it adopts when the CD case has been inserted.

The container typically comprises a generally rectangular box having clear plastic or similar side walls 1 and an open end face 2 giving a closed ended rectangular chamber within the container. The side walls 1 can be solid or partially open so that the contents of the container can be inspected externally. The side walls can also carry magnetic or other labels which actuate an alarm system if the container is removed from the display or shop. The container is, apart from the locking mechanism, of conventional design and construction. Thus, as shown in FIG. 1, the foot of the container can have a stepped configuration so that the narrower portion 3 slides within the transverse groove of a magnetic locking mechanism actuator (not shown) as used to withdraw the locking pins in present designs of container. It is also preferred that the narrower portion 3 of the container corresponds in width to the width of the CD case or other article it houses so that the foot of the container of the invention can be mounted in the existing article display systems. The container is dimensioned so that a case 4 for a CD, shown dotted in FIGS. 1 and 2, is a sliding fit within the container.

Figure 3:
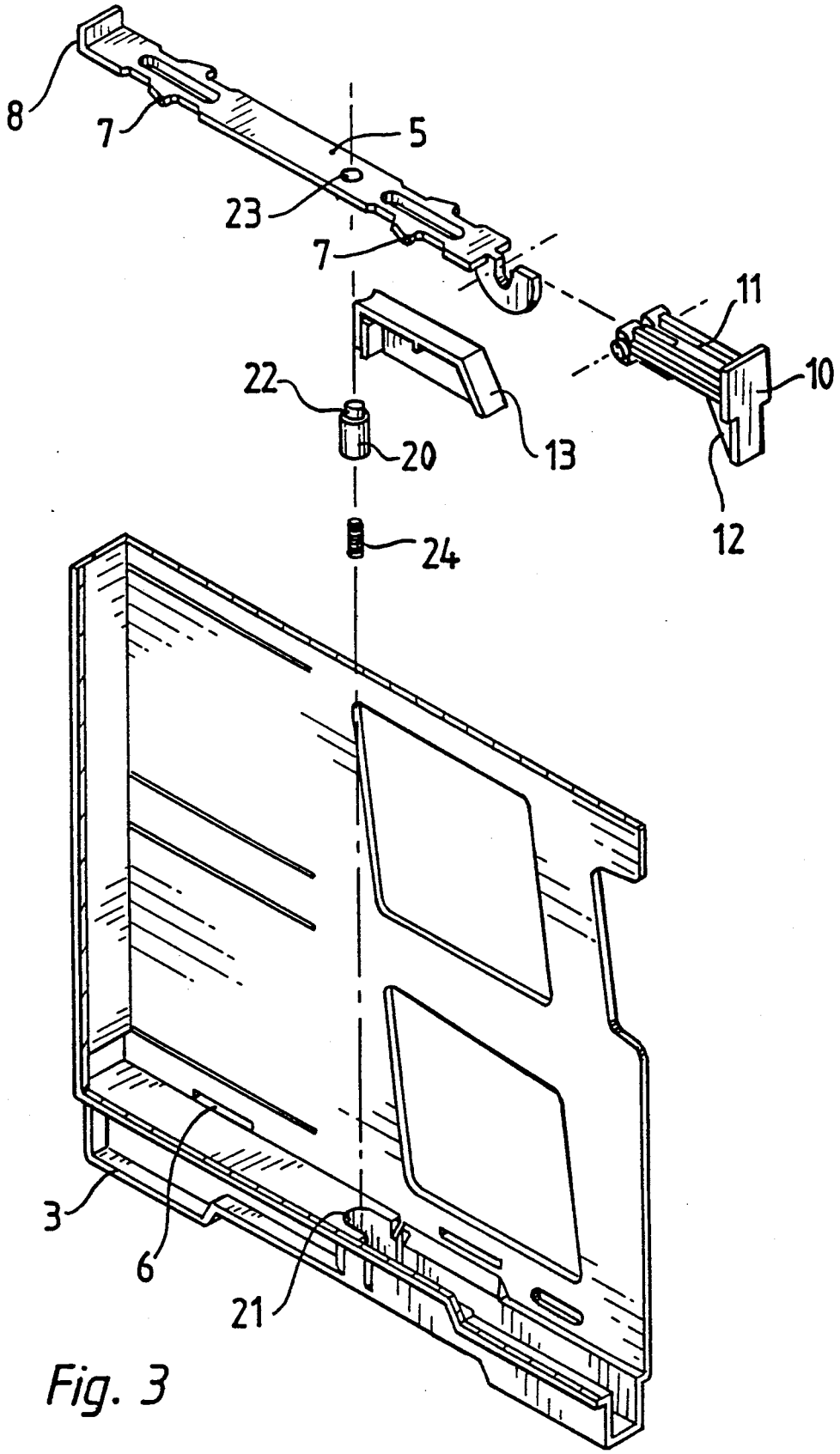
FIG. 3 is an exploded view of the main components of the container of FIG. 1.

The basal wall of the container is provided with an internal sole plate 5 which lies parallel to the internal face of the basal wall and is an axial sliding fit upon the basal wall. If desired, the side walls 1 of the container can carry inwardly projecting ribs or the like extend over the upper edge of plate 5 and serve to locate and guide plate 5; or slots 6 can be formed in the base of the side walls 1 into which lugs 7 carried by plate 5 engage, as shown in FIGS. 1 and 3.

The sole plate 5 forms a sliding carrier for the base of the CD case 4, so that the case 4 is a close fit within the container. In the form of plate shown in FIG. 1, the plate 5 carries a rearward upstanding stop 8 against which the rear corner of the CD case 4 butts as it is inserted into the container. This causes plate 5 to slide axially within the container automatically as the case 4 is inserted. However, the stop 8 can be omitted and the plate 5 moved axially by the user as the CD case 4 is inserted or removed from the container. Alternatively, the upper face of plate 5 can be provided with a high friction surface so that the CD case carries the plate 5 with it by friction. Thus, for example, the upper face of plate 5 can carry a foam plastic or other compressible layer so as to accommodate variations in the height of the CD case and this will also act as a high friction interface between the plate 5 and the base of the CD case.

In the form of container shown in FIG. 1, the plate 5 carries at its forward end a stop 10 which is to trap the forward corner of the CD case 4 when the plate is locked in position. The stop 10 is conveniently a simple upstand as shown. However, other forms of stop may be used. As indicated above, the stop 10 need not be carried by the plate 5, but could alternatively or in addition be carried at the upper lip to the open face 2 of the container so that the upper corner of the CD case 4 is trapped by the stop 10, as shown in FIG. 2. For convenience, the invention will be described hereinafter in terms of the stop 10 being carried by plate 5.

Plate 5 is formed so that when the plate is locked in its operative position, the stop 10 traps the exposed lower corner of the CD case and thus prevents the case from being removed from the container. In order to remove the container, the stop 10 has to be removed from the path of travel of the case. This can be done by forming the plate 5 from a flexible material so that it can be deflected downwardly as it is moved axially out of the container. Alternatively, plate 5 can be formed with a pivoting end portion 11 as shown in the drawings. If desired, the side walls 1 of the container can be provided with ribs or grooves within which the edge of the plate 5 travels which automatically deflect the end portion of plate 5 downwardly, or the plate 5 can be deflected by the user as it is withdrawn from the container. In a further alternative, the plate 5 can be substantially rigid and pivot about one of the lugs 6 engaging in the grooves 7 in the side walls 1 when the plate has been withdrawn to part or all of its travel and the exposed end of the plate 5 has been carried over a recess in the basal wall of the container or over the end of the basal wall of the container so that the stop 10 can be carried clear of the path of the case 4.

It is also within the scope of the present invention for the stop 10 to be deflected sideways to clear the path of travel of the CD case. For example, the stop 10 and its supporting portion 11 of plate 5 can be split vertically to form two leaves which can be splayed as the plate 5 is withdrawn from the container, e.g. manually by the user or by a static pin located within the split which causes the split to splay.

For convenience, the invention will be described hereinafter in terms of a plate 5 which has a pivotally linked end portion 11 which allows the end portion to droop and carry stop 10 clear of the path of the CD case 4. In this design, the pivoted end portion 11 can drop as the tip of this portion of the plate clears the front edge of the basal wall of the container as shown in FIG. 1. If desired, the end portion 11 can have a cam or ramp 12 which is a sliding contact with the edge of container 1 or a corresponding slope or ramp 13 in the base of the container to aid alignment of the portion 11 with the remainder of plate 5 as it is carried into the container.

The basal wall of the container or the base of either or both side walls 1 of the container are provided with a retaining means which engages plate 5 to retain it against axial movement with respect to the container, so that stop 10 thus retains the CD case 4 within the container. The retaining means can be a spring loaded clamp or jaw which acts to grip the plate 5. However, it is preferred that the retaining means positively engage with the plate 5, for example by engaging in a slot or recess so that the plate is positively locked in position once it reaches the desired position within the container. Thus, as shown in the drawings, a pin 20 is a spring biassed mounting in a bore or recess 21 in the basal wall of the container. The exposed head 22 of the pin 20 locates with a hole 23 in plate 5 when the plate 5 has been moved fully into the container and stop 10 engages the front edge of the CD case 4. The bias of spring 24 ensures that the pin automatically engages into hole 23 when they are in register. The CD case is now held securely within the container and pin 20 must be retracted from hole 23 to release plate 5 for axial movement. In an alternative, the pin 20 can be replaced with a ratchet which engages a saw tooth under surface to plate 5 so that the plate can be moved axially into the container but cannot be withdrawn until the ratchet is held clear of the saw teeth.

The retaining means incorporates means by which the plate can be released externally but which cannot be activated by the user. Typically, this will take the form of a magnet actuated release which is operated by the sales person as with current designs of container. As indicated above, the base of the container has a narrower portion which locates in the slot of a counter mounted magnet release and the base of the pin 20 is journalled within this narrowed portion. The pin is made from magnetisable material, notably a mild or tool steel, so that the magnet acts on the pin to move it longitudinally to withdraw the head 22 from hole 23. Plate 5 is then released to move axially.

The magnetic release means can act on other parts of the mechanism to release plate 5 for axial movement. Thus, the pivoted end portion 11 of plate 5 can be biassed by a leaf or other spring to the position at which stop 10 lies in the withdrawal path of case 4.

In a yet further alternative, the end portion can incorporate a magnet or magnetisable component so that the magnetic release means causes the end portion to droop against the bias of the spring means and thus clear the case for axial movement. In this version of the locking mechanism, the plate 5 need not be present since the pivoted end portion acts as a latch which is displaced laterally to clear the path of the case.

From another aspect, the invention therefore provides a container adapted to receive in a sliding fit through an open face thereof an article, the container being provided with a stop means carried on a biassed arm, which stop means is moveable by a separate external magnetic release means from its normal operative position to which it is biassed by the biassing means and in which it obstructs the withdrawal path of the article from the container, to an inoperative position at which releases the article for removal from the container.

In the form of retaining means shown in the drawings, the mechanism is contained within the container wall and is not exposed to the user. This aids smooth insertion of the container into a display rack or the like and also reduces the risk of unauthorized operation of the release mechanism.

The container shown in the drawings operates as follows. When empty, the plate 5 is pulled forward to allow the pivoted end portion 11 to droop, thus allowing the front end of a CD case 4 to be inserted through the open end face 2 into the container. The pin 20 is out of register with hole 23 in plate 5 and the plate can thus move axially, with the head 22 being biassed to bear against the underside of plate 5 by the action of spring 24. As the CD case 4 is pushed further into the container, its front end butts against stop 8 at the rear end of plate 5. This causes plate 5 to be carried axially into the container. The ramp 12 on end portion 11 engages the ramp 13 in the container and lifts the stop 10 into engagement with the rear end of case 4. The stop 10 lies in the withdrawal path of case 4 and prevents its removal from the container until stop 0 is removed from the path of travel of case 4. As case 4 is pushed home in the container, pin 20 is brought into register with hole 23 in plate 5. The head engages the hole and locks plate 5 against relative axial movement within the container. Case 4 is now secured within the container by stop 10.

When the case 4 is to be removed, the narrow section 3 of the base of the container is inserted into the slot of a counter mounted magnet release means under the control and supervision of the sales person with pin 20 aligned with the magnet. This causes pin 20 to be withdrawn from engagement with hole 23. Plate 5 can now be moved axially, allowing the case 4 to be withdrawn from the container sufficiently to allow end portion 11 to droop removing stop 10 from the path of the case 4. The case can then be totally withdrawn from the container. This leaves the plate 5 in the withdrawn position with end portion in the drooped position. A replacement case 4 can then be inserted and locked within the container without the need to use the magnetic release means as is necessary with the present designs where the detent member obstructs the insertion of a new CD disc unless it is withdrawn.

From a preferred embodiment therefore, the invention further provides a container for a generally rectangularly shaped planar article, which container comprises a housing having one open face through which the article is to be inserted into a chamber within the housing, which chamber is substantially congruent to the outer surface of the article, the housing having a detent mechanism which retains the article within the chamber, which detent mechanism is adapted to be released by a separate and external release mechanism so as to permit the article to be removed from the chamber when the housing is presented to the release mechanism; characterised in that the detent mechanism comprises:

a. a biassed member mounted for transverse inward and outward movement with respect to a wall of the chamber and which is adapted to engage with the article or a sliding member operatively associated therewith when the biassed member is free to move on its inward travel;

b. a said sliding member which lies adjacent the internal face of the said wall of the chamber and is adapted to move axially with respect to the said biassed member, the sliding member having an aperture adapted to be brought in and out of register with said biassed member by said axial movement whereby, when said aperture is in register with said biassed member, the biassed member may move inwardly to engage said aperture to retain said sliding member at a predetermined position in said housing until said biassed member is retracted by said release mechanism to release said sliding member for axial movement with respect to the chamber wall; and c. a stop member provided either by said biassed member or carried by said sliding member, which stop member is adapted to engage said article when the article is inserted into said chamber and thereby retain said article within said housing.

The invention has been described above in terms of a container for a CD case. However, the locking mechanism incorporating a stop member which has to be moved out of the path of the article can be applied to a wide range of other applications where it is desired that the locking mechanism should be one which cannot be released except by an authorised person having access to the necessary release mechanism.

What we claim is:

1. A container adapted to contain at least one article, which container has access means whereby the article can be inserted into or removed from the container, the container being provided with a detent mechanism adapted to retain the article within the container, which detent mechanism comprises:

a. a sole plate member located adjacent the interior face of one wall of the container and adapted to move axially substantially parallel to the plane of that wall and to bear against a face of the article which is to be inserted into or removed from the container through said access means;

b. a biassed member adapted to move between an operative position towards which the member is biassed by a biassing means, at which the member engages the sole plate member so as to retain it against axial movement, and an inoperative position, at which the biassed member permits axial movement of the sole plate member; and.

c. a stop member adapted to engage said article and to retain said article within the container when said biassed member engages the sole plate member in its operative position.

2. A detent mechanism suitable for use with a container into which an article is to be inserted and retained within that container by engagement with said detent mechanism, which detent mechanism comprises the combination of:

a. a sole plate member adapted to be located internally in the container and adjacent one wall of the container and adapted to move axially substantially parallel to the plane of that wall and to bear against a face of the article which is to be inserted into or removed from the container;

b. a biassed member adapted to move between an operative position towards which the member is biassed by a biassing means, at which the biassed member engages the sole plate member so as to retain it against axial movement, and an inoperative position, at which the biassed member permits axial movement of the sole plate member; and c. a stop member adapted to engage said article and to retain said article within the container when said biassed member engages the sole plate member in its operative position.

3. A container as claimed in claim 1, wherein the stop member is carried by said sole plate member.

4. A container as claimed in claim 1, wherein a second stop member is carried by the sole plate member, which second stop member is adapted to engage said article as it is inserted into the container, whereby the sole plate member is moved axially by said article as it is inserted into the container so that the first stop member prevents removal of the article from the container when the sole plate is carried by the article to the position at which the sole plate member is engaged by the biassed member.

5. A container as claimed in claim 1, wherein the sole plate member is provided with a portion which is adapted to move transversely out of the path of the article as the article is withdrawn from the container so that the first stop member and the article move transversely with respect to one another so that the first stop member is adapted to move out of the path of the article and thus permit removal of the article from the container.

6. A container as claimed in claim 1, wherein the article is a sliding fit within a generally rectangular chamber within the container.

7. A container as claimed in claim 1, wherein the article is a case for a compact disc, an audio or a video cassette tape.

8. In a container for a generally rectangularly shaped planar article, which container comprises a housing having one open face through which the article is to be inserted into a chamber within the housing, which chamber is substantially congruent to the outer surface of the article, the housing having a detent mechanism which retains the article within the chamber, which detent mechanism is adapted to be released by a separate and external release mechanism so as to permit the article to be removed from the chamber when the housing is presented to the release mechanism; the improvement which is characterised in that the detent mechanism comprises:

a. a biassed member mounted for transverse inward and outward movement with respect to a wall of the chamber and which is adapted to engage a sliding member operatively associated with the article when the biassed member is free to move on its inward travel;

b. wherein said sliding member lies adjacent the internal face of the said wall of the chamber and is adapted to move axially with respect to the said biassed member, the sliding member having an aperture adapted to be brought in and out of register with said biassed member by said axial movement whereby, when said aperture is in register with said biassed member, the biassed member may move inwardly to engage said aperture to retain said sliding member at a predetermined position in said housing until said biased member is retracted by said release mechanism to release said sliding member for axial movement with respect to the chamber wall; and c. a stop member carried by said sliding member, which stop member is adapted to engage said article when the article is inserted into said chamber and thereby retain said article within said housing.

9. A container as claimed in claim 8 wherein said sliding member carries a second stop member which is adapted to be engaged by the article as it is inserted into said chamber whereby the sliding member is carried by said article as it is inserted into the said chamber to move the sliding member axially to bring said aperture into register with said biassed member.

10. A container as claimed in claim 8, wherein the biassed member incorporates a magnetic component and said release mechanism operates magnetically to move said biassed member outwardly to release said sliding member for axial movement with respect to the biassed member.

* * * * *